US008508441B2

(12) United States Patent
Kimura et al.

(10) Patent No.: US 8,508,441 B2
(45) Date of Patent: Aug. 13, 2013

(54) SELF-LUMINESCENT DISPLAY DEVICE HAVING A TEMPERATURE AND LIGHT SENSOR FOR CORRECTING IMAGE DATA AND ELECTRONIC APPARATUS THEREOF

(75) Inventors: Fusashi Kimura, Matsumoto (JP); Atsunari Tsuda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 477 days.

(21) Appl. No.: 12/753,193

(22) Filed: Apr. 2, 2010

(65) Prior Publication Data

US 2010/0265228 A1 Oct. 21, 2010

(30) Foreign Application Priority Data

Apr. 17, 2009 (JP) ..... 2009-101030

(51) Int. Cl.
*G09G 3/30* (2006.01)

(52) U.S. Cl.
USPC ..... 345/77; 345/81

(58) Field of Classification Search
USPC ..... 345/77, 81
See application file for complete search history.

(56) References Cited

U.S. PATENT DOCUMENTS 6,806,852 B2 10/2004 Ishizuka et al.
2005/0007392 A1 * 1/2005 Kasai et al. ..... 345/690
2008/0074361 A1 * 3/2008 Lee et al. ..... 345/77
2008/0186265 A1 * 8/2008 Lee ..... 345/82
2009/0033685 A1 * 2/2009 Park et al. ..... 345/690
2009/0058888 A1 * 3/2009 Chou et al. ..... 345/690
2009/0147032 A1 * 6/2009 Kim ..... 345/690

FOREIGN PATENT DOCUMENTS

JP A-2002-116732 4/2002
JP A-2005-019353 1/2005
JP A-2007-240812 9/2007
JP A-2008-176115 7/2008

* cited by examiner

*Primary Examiner* — Chanh Nguyen
*Assistant Examiner* — Long D Pham
(74) *Attorney, Agent, or Firm* — Oliff & Berridge, PLC

(57) ABSTRACT

A self-luminescent display device includes a pixel unit in which a plurality of pixels including a self-luminescent pixel is arranged, an external light sensor which measures an external light intensity, a temperature sensor which measures an environmental temperature, an image correcting unit which corrects image data input to the image correcting unit on the basis of statistical data of the image data, a light adjusting unit which produces a light adjusting signal on the basis of a measurement signal of the external light sensor, a temperature control unit which produces a temperature correcting signal on the basis of a measurement signal of the temperature sensor, and a display control unit which produces a brightness correcting signal for correcting light emitting brightness of the pixels in the pixel unit on the basis of the light adjusting signal and the temperature correcting signal. The light emitting brightness of the pixels in the pixel unit is adjusted on the basis of the image data corrected by the image correcting unit and the brightness correcting signal.

3 Claims, 10 Drawing Sheets

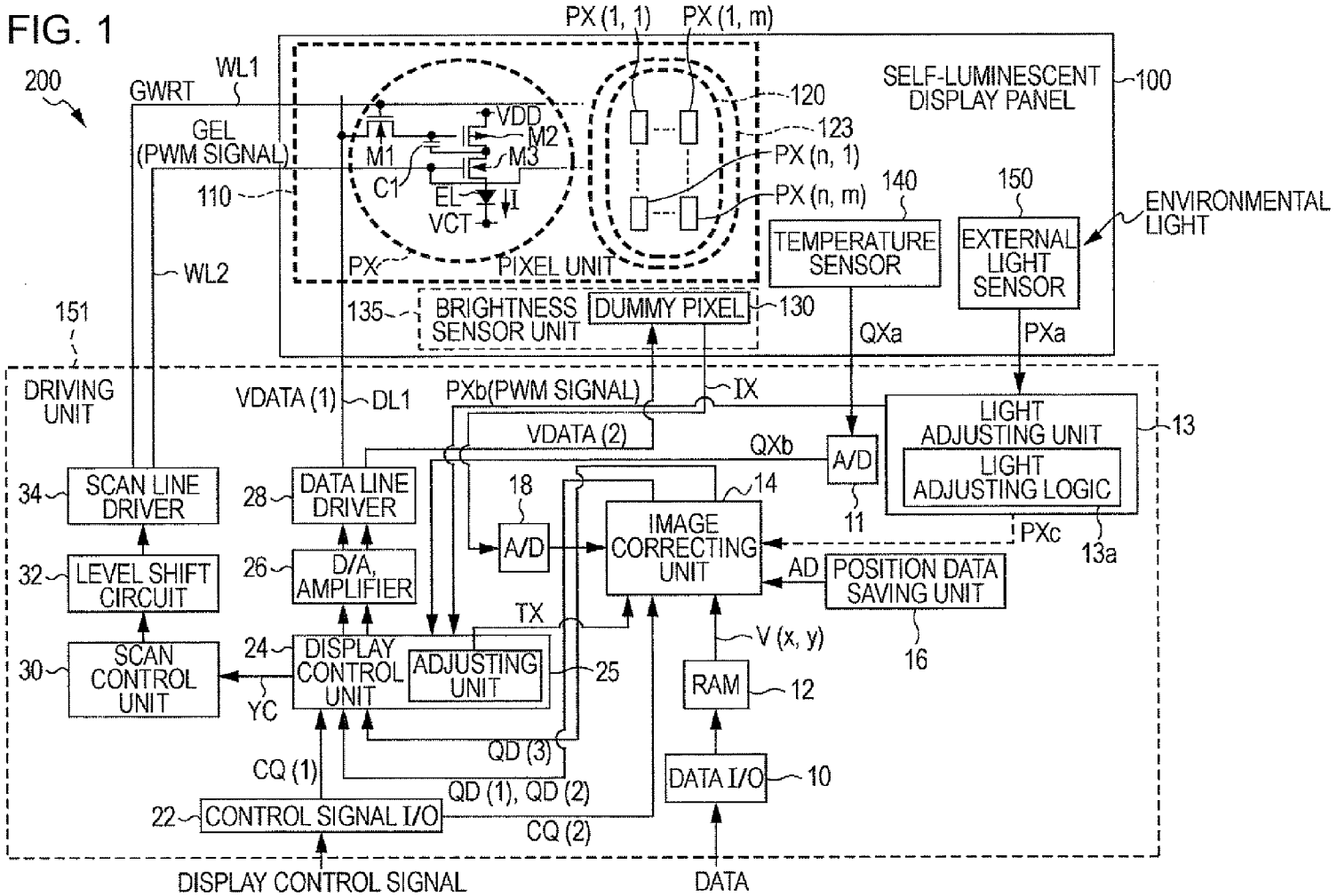
FIG. 1
200
SELF-LUMINESCENT DISPLAY PANEL
100
ENVIRONMENTAL LIGHT
EXTERNAL LIGHT SENSOR
150
PXa
TEMPERATURE SENSOR
140
QXa
PX (1, m)
PX (1, 1)
PX (n, 1)
PX (n, m)
120
123
130
DUMMY PIXEL
PIXEL UNIT
BRIGHTNESS SENSOR UNIT
135
PX
VDD
M1
M2
M3
C1
EL
VCT
WL1
WL2
GWRT
GEL (PWM SIGNAL)
110
DL1
VDATA (1)
VDATA (2)
IX
PXb(PWM SIGNAL)
QXb
LIGHT ADJUSTING UNIT
13
LIGHT ADJUSTING LOGIC
13a
PXc
A/D
11
POSITION DATA SAVING UNIT
16
AD
IMAGE CORRECTING UNIT
14
V (x, y)
RAM
12
DATA I/O
10
DATA
A/D
18
TX
ADJUSTING UNIT
25
QD (3)
QD (1), QD (2)
CQ (2)
DATA LINE DRIVER
28
D/A AMPLIFIER
26
DISPLAY CONTROL UNIT
24
YC
CQ (1)
CONTROL SIGNAL I/O
22
DISPLAY CONTROL SIGNAL
DRIVING UNIT
151
SCAN LINE DRIVER
34
LEVEL SHIFT CIRCUIT
32
SCAN CONTROL UNIT
30

SELF-LUMINESCENT DISPLAY DEVICE HAVING A TEMPERATURE AND LIGHT SENSOR FOR CORRECTING IMAGE DATA AND ELECTRONIC APPARATUS THEREOF

BACKGROUND

1. Technical Field

The present invention relates to a self-luminescent device and an electronic apparatus.

2. Related Art

Light emitting efficiency of an organic EL element that is a self-luminescent element changes depending upon temperature. Thus, light emitting brightness changes depending upon a change of environmental temperature, a change of panel temperature caused by self-heat generation and so on. In order to deal with such changes, a technology for correcting a light emitting intensity of pixels including light emitting elements on the basis of an output of a temperature sensor is disclosed, e.g., in JP-A-2007-240812. Further, easiness to see of a screen also changes depending upon external light intensity. In order to deal with such a change, a technology for correcting a light emitting intensity of pixels including light emitting elements on the basis of an external light intensity is disclosed, e.g., in JP-A-2005-19353.

As an external light intensity and a temperature suddenly change in accordance with surrounding conditions in some cases, it is difficult to most suitably correct an image on, e.g., a display panel to be mounted on a mobile electronic device only by means of light emitting brightness control based on either one of the external light and the temperature.

Further, in a case where a display device using a self-luminescent element such as an organic EL element displays a highly bright image such as an all white image (i.e., most of pixels of a screen emit highly bright light), degradation of the pixels is accelerated resulting in a change of image quality and an increase of power consumption.

Further, if a portion of a pixel unit regularly emits light for a long time and a display of same image data continues in the portion for a long time, characteristics of pixels are severely degraded in the portion, screen burn-in occurs and a brightness difference between the portion and a surrounding area increases resulting in brightness unevenness in some cases. An organic EL display panel, e.g., installed on a vehicle displays meters while the vehicle is traveling, and displays a navigation or TV image while the vehicle is not traveling in some cases. A display area for outer fringes, gauges or numerals of the meters regularly emits light, and their displayed data is rarely changed. Thus, if the vehicle travels for a long time, characteristics of the organic EL elements of the portion which indicates the outer fringes, gauges and numerals of the meters severely change (they are severely degraded), possibly resulting in screen burn-in. If the displayed image changes from the image of the meters to a navigation or TV image after the screen burn-in occurs, brightness in the portion where the screen burn-in has been caused by the display of the meters may possibly change from a precise value beyond an allowable range, and may possibly degrade quality of the navigation or TV image which should primarily be highly precise.

Ordinary image correction technologies cannot optimize light emitting brightness in such a way, e.g., as to properly deal with all the above problems. According to at least one embodiment of the invention, e.g., light emitting brightness of a self-luminescent display device can be optimized by means of an adaptive control which deals with all the heat generation caused by environmental temperature, external light and self-emitted light, and more preferably, a compensation for degradation can be performed for screen burn-in which partially occurs.

SUMMARY

An embodiment of the self-luminescent display device of the invention includes a pixel unit in which a plurality of pixels including a self-luminescent pixel is arranged, an external light sensor which measures an external light intensity, a temperature sensor which measures an environmental temperature, an image correcting unit which corrects image data input to the image correcting unit on the basis of statistical data of the image data, a light adjusting unit which produces a light adjusting signal on the basis of a measurement signal of the external light sensor, a temperature control unit which produces a temperature correcting signal on the basis of a measurement signal of the temperature sensor, and a display control unit which produces a brightness correcting signal for controlling light emitting brightness of the pixels in the pixel unit on the basis of the light adjusting signal and the temperature correcting signal, wherein the light emitting brightness of the pixels in the pixel unit is adjusted on the basis of the image data corrected by the image correcting unit and the brightness correcting signal.

According to the embodiment, three kinds of light emitting brightness control are performed. That is, an image data correction based on statistical data of input image data, a light emitting brightness control based on external light (environmental light) and a light emitting brightness control based on temperature (including both environmental temperature and temperature caused by self-heat generation of a self-luminescent element) are performed.

For instance, the image correcting unit analyzes a brightness histogram of the input image data and corrects the image data in such a way, if it is identified that the light emitting brightness of the whole screen is high like an all-white image, as to shift the brightness histogram (brightness distribution) to a low brightness side. Thus, e.g., even if a highly bright image close to an all-white image is displayed for a long time, degradation of pixels is prevented and something like screen burn-in less probably occurs. Further, as driving currents of individual pixels are suppressed, effects of reducing power consumption in the pixel unit and of a longer lifetime of a display panel are obtained. Further, the display control unit produces a brightness correcting signal on the basis of a light adjusting signal produced on the basis of an external light intensity and a temperature correcting signal produced on the basis of a temperature. Light emitting brightness of the pixels is adjusted by means of the brightness correcting signal. For instance, a brightness correction is made such that the light emitting brightness of the pixels in case of intense external light (the surrounding are light) is rendered high as the screen becomes hard to see in such a case, and that the light emitting brightness of the pixels in case of weak external light (the surrounding are dark) is rendered lower than that in the light surroundings case. Further, if brightness of an organic EL element rises almost in proportion to the temperature, a brightness correction is made by means of an opposite correction characteristic to the brightness change of the organic EL element (as to the above example, a characteristic such that the brightness almost linearly falls as the temperature rises) so as to suppress the rise of the brightness.

As methods for adjusting light emitting brightness by means of the brightness correcting signal, a method for further correcting image data that has been corrected on the basis, e.g., of statistical data can be employed, and a method for variably controlling a duty ratio of a PWM signal which drives a light emitting control transistor included in the pixel circuit by means of a brightness correcting signal can be employed. The latter method has an added advantage of making the brightness correcting process efficient by correcting the image data on the basis of the statistical data and producing the brightness correcting signal on the basis of the external light intensity and the temperature data independently and in parallel. For a display panel to be mounted on a mobile electronic device, e.g., an external light intensity and a temperature can suddenly change according to surrounding conditions in some cases. According to the embodiment, as the input image data is corrected and the light emitting brightness is controlled on the basis of both the external light and the temperature in an overlapping manner, the environment in which the display device is put and a brightness tendency of the input image can be totally taken into account, so that an optimum image correction is implemented. For instance, the brightness correction is made neither too much nor too little, and quality of the displayed image can be enhanced.

According to another embodiment of the self-luminescent display device of the invention, each of the pixels has a self-luminescent element, a driving transistor which provides the self-luminescent element with a driving current, and a light emitting control transistor which controls a period of time for which the self-luminescent element emits light. The image correcting unit makes a brightness histogram of the input image data. The image correcting unit analyzes the brightness histogram. The image correcting unit corrects the image data provided to the pixels upon a brightness value of a whole image being more than a certain threshold so that brightness of the whole image decreases. The display control unit produces the brightness correcting signal as a PWM signal of a variable duty ratio on the basis of the external light intensity and the environmental temperature. The display control unit controls an on/off state of the light emitting control transistor in the pixel by means of the brightness correcting signal as the PWM signal of the variable duty ratio.

According to the embodiment, the image correcting unit makes and analyzes a brightness histogram of input image data. If brightness of the whole displayed image is higher than a certain threshold, the image correcting unit corrects pixel data in such a way as to decrease the brightness of the whole displayed image. For instance, the image correcting unit analyzes the brightness histogram of the input image data. If, e.g., a brightness average of all the pixels is higher than a certain threshold, or if, e.g., the number of those of the whole pixels for which the light emitting brightness is higher than a certain brightness value (reference brightness) is more than a certain threshold (e.g., more than 80 percent of the whole), the image correcting unit identifies that the light emitting brightness of the whole screen is high, and corrects the image data in such a way as to shift the brightness histogram (brightness distribution) to a low brightness side.

Further, the display control unit produces a brightness correcting signal as a PWM signal of a variable duty ratio. An on/off state of a light emitting control transistor (light emitting control element: e.g., plays a role in controlling timing or a period of time for which the self-luminescent element emits light) included in the pixel circuit is controlled by means of the brightness correcting signal. The period of time for which the self-luminescent element emits light is thereby controlled, and light emitting brightness of individual pixels is adjusted. The method of the embodiment has an effect of correcting the image data on the basis of the statistical data and producing the brightness correcting signal on the basis of the external light intensity and temperature data independently and in parallel, and of making the brightness correcting process efficient and easy.

According to another embodiment of the self-luminescent display device of the invention, the display control unit further has an adjusting unit which changes, upon the duty ratio of the brightness correcting signal being as the PWM signal is less than a certain duty ratio, the duty ratio of the brightness correcting signal being as the PWM signal to a value more than the certain duty ratio. The adjusting unit provides the image correcting unit with a brightness adjusting signal for compensating for an increase of the light emitting brightness of the pixels caused by the change of the duty ratio.

If the period of time for emitting light of the light emitting control transistor (light emitting control element) is variably controlled by means of the brightness correcting signal that is a PWM signal of a variable duty ratio, and if, e.g., the temperature is high and the surroundings are dark, the duty ratio of the PWM signal becomes less than a certain duty ratio value (e.g., 50 percent) in some cases as the light emitting brightness is significantly suppressed. If the duty ratio of the PWM signal becomes, e.g., less than 50 percent, a period of time for which the light emitting element is not lit extends and a flicker may possibly occur. Thus, according to the embodiment, in such a case, the adjusting unit makes the duty ratio of the PWM signal more than, e.g., 50 percent (i.e., bans a light emitting control such that the duty ratio is less than the certain duty ratio value and maintains the duty ratio at, e.g., the certain duty ratio (i.e., 50 percent)) and, instead, provides the image correcting unit with a brightness adjusting signal for compensating an increase of the light emitting brightness of the pixels caused by the change. Upon receiving the brightness adjusting signal, the image correcting unit makes a correction for decreasing the brightness value of the whole image by, e.g., shifting the brightness histogram to the low brightness side so that the brightness value equals a value indicated by the brightness adjusting signal. The brightness value of the pixels is thereby optimized, and image quality degradation caused by the flicker is surely prevented.

According to another embodiment of the self-luminescent display device of the invention, the pixel unit incorporates a first area to be a target for degradation monitoring and a second area surrounding the first area set in the pixel unit. The self-luminescent display device further has a brightness sensor unit including a dummy pixel which emits light in a same condition as at least one of the pixels included in the first area. The brightness sensor unit is for detecting a secular change of the light emitting brightness in the first area in the pixel unit. The image correcting unit corrects at least one of light emitting brightness of at least one of the pixels included in the first area and light emitting brightness of at least one of the pixels included in the second area on the basis of a detection signal of the brightness sensor unit so that a difference between light emitting brightness of at least one of the pixels included in the first area and light emitting brightness of at least one of the pixels included in the second area decreases.

According to the embodiment, a partial brightness correction focusing on a severely degraded portion of the screen is made in addition to the brightness correction of the whole screen, and a more flexible and sophisticated adaptive brightness correcting process is performed. According to the embodiment, e.g., a first area to be a target for degradation monitoring is set in the pixel unit (display area) in advance. As to the example described above, e.g., a portion in which outer fringes, gauges and numerals of meters are displayed is set as the first area (degradation monitoring area). Further, a second area (surrounding area) surrounding the first area is set in advance. The second area is selected in advance, e.g., in a portion where occurrence of brightness unevenness caused by a secular change of light emitting brightness of pixels included in the first area is predicted. As to the example described above, the second area corresponds to, e.g., a portion in which needles of meters are displayed (e.g., displayed only if necessary) or a background portion (e.g., a portion of very weak light emitting brightness and little degradation). The brightness sensor unit includes a dummy pixel which emits light in a same condition (e.g., display color, display brightness, display timing and so on) as at least one of the pixels included in the first area. As the first area is formed by a plurality of pixels, a light emitting condition of a typical one of the pixels (e.g., a pixel expected to be most severely degraded) can be made the light emitting condition of the dummy pixel. To put it specifically, e.g., the dummy pixel is driven by a driving signal synchronized with a driving signal of the typical pixel in the first area at the same time, and emits light by means of a same display data voltage as a display data voltage for the typical pixel (this is just an example, though, and how to drive the dummy pixel is not limited to the above). The brightness sensor monitors a degree of a brightness change (i.e., a degree of degradation of a characteristic of the light emitting element), e.g., by detecting a current consumed by the dummy pixel. Meanwhile, it is conceivable that light emitted by the dummy pixel is received by a light receiving element and an amount of the received light is converted into an electric signal so that the brightness change is monitored.

The image correcting unit corrects light emitting brightness of at least one of at least one of the pixels included in the first area and at least one of the pixels included in the second area so that a difference between light emitting brightness of at least one of the pixels included in the first area (degradation monitoring area) and light emitting brightness of at least one of the pixels included in the second area (surrounding area) decreases. As the first area can be specified in advance, e.g., at a design phase, position data of the first area (coordinates in the pixel unit, an address in the frame memory, etc.) can be specified in advance. position data of the second area can be similarly specified in advance. Thus, if the position data is saved in a ROM and so on, each of the areas can be distinguished during a compensation for secular degradation. If, e.g., a portion in which outer fringes, gauges and numerals of meters are displayed is made the first portion and a portion of needles or a background of the meters arranged around the first portion is made the second area, and if screen burn-in has been caused by a long time display of the meters in the first area, e.g., it is conceivable to decrease the light emitting brightness in the first area, to decrease the difference compared with the light emitting brightness in the second area and to thereby make the brightness unevenness inconspicuous. Further, it is also conceivable to decrease the light emitting brightness in the first area, to increase the light emitting brightness in the second area in parallel, and to thereby suppress the brightness unevenness. At this moment, if, e.g., the background portion in the second area affects a human sense of sight little, a method for increasing the light emitting brightness in the needle portion can be employed, so that the target area for the brightness correction can be minimized.

According to the embodiment, as a portion of severe secular degradation is focused on and the brightness in an area around an interface between the portion and the surroundings is intensively corrected, size of pixels to be made a target for the correction can be made small and a load of the correcting circuit can be reduced. Brightness unevenness can be efficiently and effectively prevented from occurring between an area of regular light emission in which a same image is displayed for a long time and its surrounding area.

According to another embodiment of the self-luminescent display device of the invention, the image correcting unit corrects at least one of light emitting brightness of the whole pixels included in the first area and light emitting brightness of the whole pixels included in the second area so that a difference between an average value of the light emitting brightness the whole pixels included in the first area and an average value of the light emitting brightness of the whole pixels included in the second area decreases.

According to the embodiment, all the pixels included in the first area and the second area are made a target for a compensation process for secular degradation (image correcting process). The image correcting unit corrects at least one of light emitting brightness of the whole pixels included in the first area and light emitting brightness of the whole pixels included in the second area so that a difference between an average value of the light emitting brightness of the whole pixels included in the first area and an average value of the light emitting brightness of the whole pixels included in the second area decreases. A difference between a brightness level of the whole first area and a brightness level of the whole second area thereby decreases, brightness unevenness is suppressed even if a brightness characteristic of the pixels included in the first area changes as secular degradation of the characteristic of the pixel circuit and so on goes on. Thus, image quality can be prevented from being degraded.

According to another embodiment of the self-luminescent display device of the invention, the image correcting unit corrects at least one of light emitting brightness of one or a plurality of particular pixel(s) included in the first area and light emitting brightness of one or a plurality of particular pixel(s) included in the second area so that a difference between the light emitting brightness of the particular pixel(s) included in the first area and the light emitting brightness of the particular pixel(s) included in the second area decreases.

According to the embodiment, particular one(s) of all the pixels (one or a plurality of pixel(s)) included in the first area and the second area is (are) made a target for the compensation process for secular degradation (image correction process). The image correcting unit corrects at least one of light emitting brightness of one or a plurality of particular pixel(s) included in the first area and light emitting brightness of one or a plurality of particular pixel(s) included in the second area so that a difference between the light emitting brightness of the particular pixel(s) included in the first area and the light emitting brightness of the particular pixel(s) included in the second area decreases. According to the embodiment, e.g., the number of the particular pixels can be limited, so that a load of the image correcting unit can be reduced. According to the embodiment, it is preferable to carefully select a pixel (pixels) at which position as the particular pixel(s), and to obtain a maximum effect of suppressing brightness unevenness by means, e.g., of light emitting brightness correction of the minimum number of the pixels.

According to another embodiment of the self-luminescent display device of the invention, the self-luminescent display device can display a plurality of kinds of images, and the image correcting unit, upon changing an image displayed on the pixel unit from a first image to a second image, corrects the image data for compensation for secular degradation in a period of time for displaying the second image.

According to the embodiment, the compensation for secular degradation is performed upon a displayed image being changed to a different kind of image. An organic EL display panel, e.g., installed on a vehicle displays meters while the vehicle is traveling, and displays a navigation or TV image while the vehicle is not traveling in some cases. As a display area for outer fringes, gauges or numerals of the meters regularly emits light, and their displayed data is rarely changed, screen burn-in possibly occurs in that area. If the displayed image changes from the image of the meters to a navigation or TV image after the screen burn-in occurs, brightness in the portion where the screen burn-in has been caused by the display of the meters may possibly change from a precise value beyond an allowable range, and may possibly degrade quality of the navigation or TV image which should primarily be highly precise. Thus, in case of a change of the image displayed on the pixel unit from a first image (displayed image of the meters of the above example) to a second image (navigation or TV image), perform the compensation for secular degradation during a period of time for displaying the second image (navigation or TV image) according to the embodiment. For displaying a navigation image, etc., e.g., a method can be employed such as correcting image data corresponding to the first area by adding data for correcting the brightness that has increased owing to the screen burn-in in the first area (area in which the gauges of the meters, etc., were displayed) to the image data of the navigation image, etc. (or by subtracting the former from the latter). The change of the display brightness caused by the screen burn-in, etc., can thereby be suppressed and a degree of image quality degradation can be kept at a minimum.

Incidentally, e.g., while the meters are displayed, a portion of the gauges may intermittently blink and color of the numerals may secularly change in some cases. Such a change of the image is a change of the same image and is not a changeover to a different image. In case of a changeover to a different image, the image after the changeover has no relation to the image before the changeover. Thus, if a significant change of the brightness characteristic that occurred in some area before the changeover of the image affects the image after the changeover, an unnatural change of the image quality occurs in the image after the changeover. Thus, according to the embodiment, in case of a changeover to a different image (i.e., in case of a changeover from a first image to a second image), the compensation process for secular degradation is performed so that such a problem is prevented.

According to another embodiment of the self-luminescent display device of the invention, the image correcting unit corrects the image data for compensation for secular degradation in a period of time for which the self-luminescent display device continuously displays an image.

According to the embodiment, the compensation process for secular degradation is performed while an image is continuously displayed. The embodiment does not presuppose an image changeover. The image correcting unit can regularly perform the process for secular degradation, e.g., while displaying the meters, so as to decrease a difference between the brightness in the first area (e.g., the surrounding, gauge and numeral portions of the meters which regularly emit light) and the brightness in the second area (e.g., the needle portions of the meters). Further, the compensation process for secular degradation can be regularly performed throughout a period of time for which the display panel is in operation. Further, the compensation for secular degradation can be performed only if the degradation goes beyond an allowable level in the first area (e.g., if a quantity of a current consumed by the dummy pixel which shows the brightness level of the dummy pixel goes beyond a threshold) instead of regularly performing the process for secular degradation. As the period of time for the compensation for secular degradation is shortened in this case, the load of the image correcting unit and power consumption of the circuit can be reduced.

According to another embodiment of the self-luminescent display device of the invention, the self-luminescent element is an organic EL element.

The organic EL element has a characteristic such that light emitting efficiency changes depending upon temperature and brightness increases. Further, degradation of characteristics of pixels may be accelerated by self-heat generation caused by long time light emission in some cases. Thus, it is effective to apply the invention, to consider brightness distribution, external light, temperature, more preferably to consider partial pixel degradation and to make an overall brightness correction.

An electronic apparatus of the invention has one of the self-luminescent display devices described above.

The electronic apparatus equipped with the self-luminescent display device of the invention enjoys a benefit of a constant image display of high quality, small size and low power consumption.

BRIEF DESCRIPTION OF THE DRAWINGS

The invention will be described with reference to the accompanying drawings, wherein like numbers reference like elements.

FIG. 1 shows an example of a configuration of a self-luminescent display device of the invention.

DESCRIPTION OF EXEMPLARY EMBODIMENTS

Figure 2:
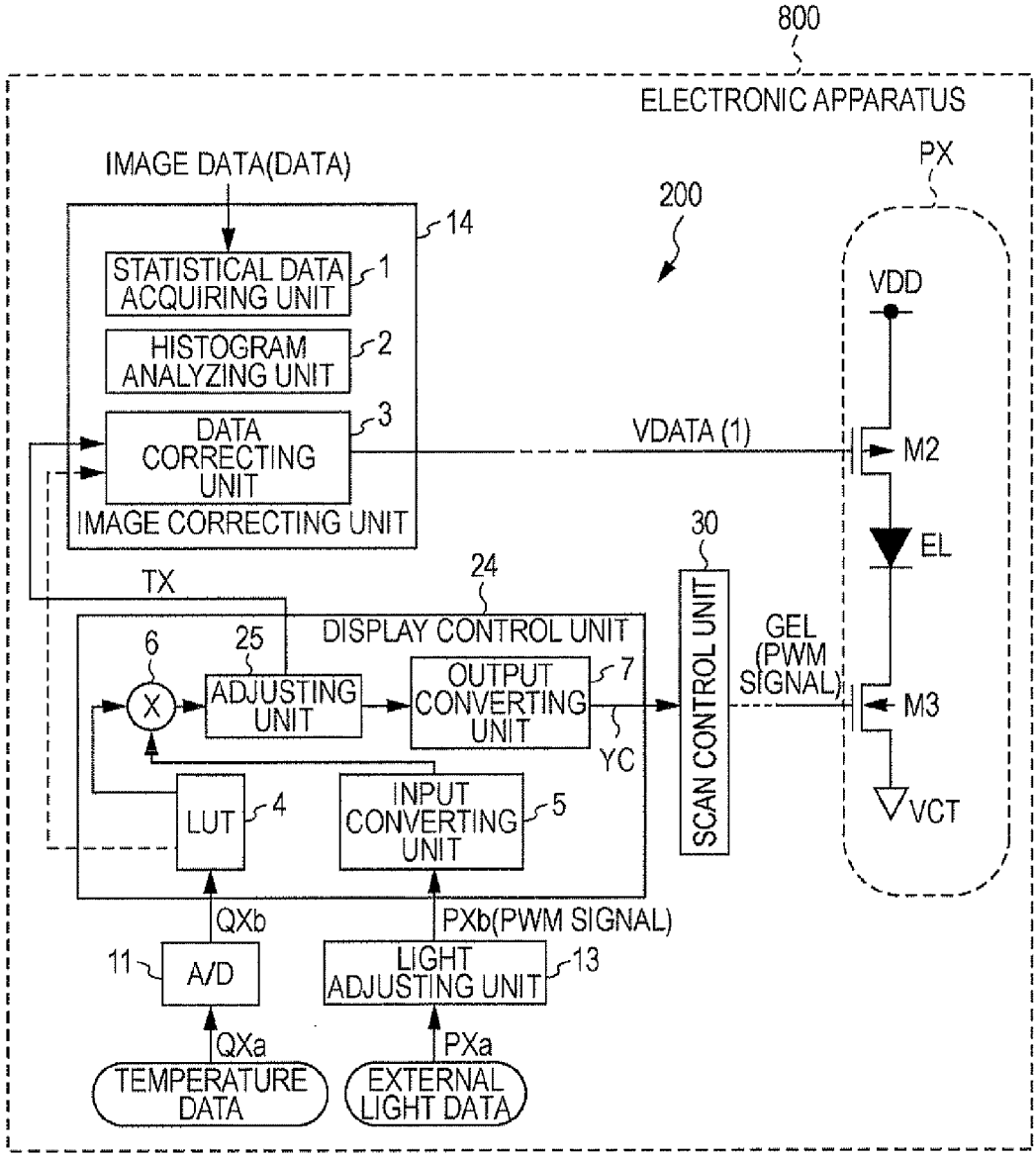
FIG. 2 illustrates light emitting brightness control based on statistical data of input image data, external light and temperature.

Then, an embodiment of the invention will be explained with reference to the drawings. The embodiment explained hereafter does not unreasonably limit content of the invention described as Claims. All portions of the embodiment which will be described are not necessarily required as means for solving the problems of the invention.

First Embodiment

FIG. 1 shows an example of a configuration of a self-luminescent display device of the invention. A self-luminescent display device 200 has a self-luminescent display panel 100 using organic EL elements and a driving unit 151 of the self-luminescent display panel.

Configuration of Self-Luminescent Display Panel

The self-luminescent display panel 100 has a pixel unit 110 in which a plurality of pixels PX are arranged in a matrix and a brightness sensor unit 135 including a dummy pixel 130.

Each of the pixels PX is provided to a crossing of each of a plurality of scan lines (to put it specifically, a first scan line WL1) and each of a plurality of data lines (DL1). The pixel PX includes a writing transistor M1, a driving transistor M2, a light emitting control transistor M3, a holding capacitor C1 and an organic EL element EL. The driving transistor M2 has a source connected to a pixel power supply voltage VDD of a high level. The organic EL element EL has a cathode connected to a pixel power supply voltage VCT of a low level. The writing transistor M1 has a gate connected to the first scan line WL1. The writing transistor M1 is turned on/off as controlled by a writing control signal GWRT. Further, the light emitting control transistor M3 has a gate connected to a second scan line WL2 and is turned on/off as controlled by a light emitting control signal GEL.

If the writing transistor M1 is turned on, the data line DL1 provides a gate of the driving transistor M2 with a display data voltage VDATA (VDATA(1)), and the holding capacitor C1 holds the display data voltage. As a voltage according to the display data voltage is applied between the gate and the source of the driving transistor M2, the driving transistor M2 outputs a driving current I corresponding to the display data voltage.

The light emitting control transistor M3 is provided for a timing adjustment of light emission of the organic EL element EL and for an adjustment of brightness of the whole pixel unit 110. The light emitting control signal GEL is a PWM (pulse width modulation) signal. While the light emitting control signal GEL is on an active level (H), the light emitting control transistor M3 is turned on and the organic EL element EL that is a self-luminescent element of a current-driven type emits light. A duty ratio of the light emitting control signal GEL (that represents a ratio of an "on" time length to an "off" time length in a period of time for which one pixel is ready to emit light) can be properly changed, e.g., so that display brightness of the whole pixel unit 110 can be finely adjusted.

Further, a first area to be a target for degradation monitoring (degradation monitoring area) 120 and a second area surrounding the first area (surrounding area) are set in the pixel unit 110 in advance. The first area 120 is a regular light emitting area that regularly emits light, e.g., throughout a period of time for which the self-luminescent display device 200 is powered on (a period of time for being in operation), and emits light in accordance with same display data for a long time. The first area 120 corresponds to, e.g., outer fringe, gauge or numeral portions of meters. The first area 120 includes a plurality of pixels (PX(1,1)-PX(n,m)). The brightness sensor unit 135 watches (monitors) a brightness change caused by long time emission, etc. in the first area 120. The self-luminescent display device 200 makes a correction of image data and so on in at least one of the first and second areas on the basis of a detection signal IX output from the brightness sensor unit 135 so as to reduce a difference in brightness between the first area 120 (e.g., the outer fringe, gauge or numeral portions of the meters) and the second area 123 surrounding the first area (e.g., needle portions of the meters).

The brightness sensor unit 135 includes at least one dummy pixel 130 that emits light in a same condition (e.g., display color, display brightness, display timing and so on) as at least one pixel included in the first area 120. As the first area 120 is formed by the plural pixels (PX(1,1)-PX(n,m)), a light emitting condition of, e.g., a typical one of the pixels (e.g., one of the pixels expected to be most severely degraded: e.g., PX(1,*m*)) can be made a light emitting condition of the dummy pixel 130.

To put it specifically, e.g., the dummy pixel 130 is driven by a driving signal synchronized with a driving signal of a typical pixel (PX(1,*m*)) in the first area 120 at the same time, and emits light on the basis of a same display data voltage as a display data voltage for the typical pixel (as just an example, though, not limited to the above, and, e.g., some difference in the light emitting condition is allowable). The brightness sensor unit 135 senses, e.g., the current IX consumed by the dummy pixel 130 and monitors a degree of the brightness change (i.e., a degree of degradation of a characteristic of the self-luminescent element). Meanwhile, a light-receiving element (such as a PIN diode provided in the self-luminescent panel) can receive light emitted by the dummy pixel 130 so as to convert an amount of received light into an electric signal to be made the detection signal IX. Incidentally, a process for compensating degradation will be explained in detail as to a second embodiment.

Further, the self-luminescent panel 100 is provided with a temperature sensor 140 and an external light sensor 150. The temperature sensor 140 includes, e.g., a PN-junction diode (not shown) biased by a temperature-compensated reference voltage. If a change of an environmental temperature (and a change of the temperature caused by heat generation in the pixel unit) occurs, a current QXa of the PN-junction diode increases as the PN-junction diode has a negative temperature characteristic. Thus, a change of the temperature can be detected by means of detection of the current QXa (as just an example, though, and not limited to the above). Further, the external light sensor 150 is constituted by, e.g., a light receiving element such as a PIN diode. The external light sensor 150 outputs a detection signal (e.g., a current signal) PXa which changes in accordance with an intensity (illuminance) of external light.

Configuration of Driving Unit

The driving unit 151 has a data I/O 10 to which image data is input from a host and so on, a RAM (a frame memory or a line memory) 12, an image correcting unit 14, a light adjusting unit 13 (having light adjusting logic 13*a*) which receives the detection signal PXa output from the external light sensor 150, an A/D converter circuit 11 which converts the detection signal QXa (analog signal) output from the temperature sensor 140 into a digital signal, a position data saving unit 16 in which position data of the first area (degradation monitoring area) 120 and the second area (surrounding area) 123 surrounding the first area, an A/D converter circuit 18 which converts an analog detection signal (monitor signal) IX output from the brightness sensor unit 135 into a digital signal, a control signal I/O 22 to which a display control signal is input from the host and so on, a display control unit 24 (including an adjusting unit 25), a D/A converter circuit & amplifier 26, a data line driver 28, a scan control unit 30 which controls driving of the scan lines (first scan line WL1, second scan line WL2), a level shift circuit 32 and a scan line driver 34.

The data line driver 28 provides the pixel unit 110 with the display data voltage (display data signal, image signal) VDATA(1) through the data line WL1, and provides the dummy pixel 130 with the display data voltage VDATA(2) for the dummy pixel (which agrees, as described above, with the display data voltage for the typical pixel (watched pixel) in the first area 120). Further, the scan line driver 34 outputs the writing control signal GWRT and the light emitting control signal GEL to the first scan line WL1 and the second scan line WL2, respectively.

The light adjusting logic 13*a* has, e.g., an A/D converter circuit, a filter circuit, a PWM signal generating circuit and so on (which are not shown). The light adjusting unit 13 produces a light adjusting signal (PWM signal) PXb and provides the display control unit with the signal PXb. Incidentally, the light adjusting unit 13 may, e.g., produce a light adjusting signal PXc that is a digital signal and provide the image correcting unit 14 with the signal PXc. Further, the detection signal QXa that is an analog signal output from the temperature sensor 140 is A/D-converted into a temperature correcting signal QXb that is a digital signal, and the signal QXb is also provided to the display control unit 24.

The image correcting unit 14 makes and analyzes a brightness histogram of input image data. Upon identifying the whole image as being brighter than a criterion, the image correcting unit 14 can make a correction for reducing the brightness of the whole image (this aspect will be described later with reference to FIG. 2).

Further, the image correcting unit 14 corrects light emitting brightness in at least one of the first and second areas (the first area 120, the second area 123 or both) on the basis of the detection signal IX of the brightness sensor unit 135 so as to reduce a difference between the light emitting brightness in the first area 120 and the light emitting brightness in the second area 123 surrounding the first area 120.

As the first area 120 can be specified in advance at a design phase, position data (such as data of coordinates in the pixel unit 110, an address in the frame memory 12) of the first area 120 can be specified in advance. The position data of the second area 123 can similarly be specified in advance. Those position data are saved in the position data saving unit 16 constituted by a ROM and so on. A process for comparing the position data saved in the position data saving unit 16 with position data (address) of image data (DATA) can be performed, so that each of the areas can be distinguished during a compensation process for secular degradation.

Assume, e.g., that a portion in which outer fringes, gauges and numerals of meters are displayed is made the first area 120, that a portion in which needles are arranged around them or a background portion of the meters are displayed is made the second area 123, and that screen burn-in caused by the meters displayed for a long time occur in the first area 120. In such a case, e.g., decrease the light emitting brightness in the first area 120 and reduce the difference compared with the light emitting brightness in the second area 123, so that brightness unevenness can be made inconspicuous. Further, e.g., increase the light emitting brightness in the second area 123 (e.g., the needle portions) and reduce the difference compared with the light emitting brightness in the first area 120, so that the brightness unevenness can be suppressed. Further, decrease the light emitting brightness in the first area 120 and increase the light emitting brightness in the second area 123 in parallel, so that the brightness unevenness can be suppressed. It is preferable to sufficiently consider an effect on the human sense of sight for setting the second area 123. If, e.g., the background portion of the meters have an insignificant effect on the human sense of sight, employ a method for increasing the light emitting brightness only of the portion of the needles (i.e., make only the portion of the needles the second area 123 excluding the background portion), so that the area in which the light emitting brightness is corrected can be minimized. A processing load of the image correcting unit 14 can thereby be reduced.

The image correcting unit 14 outputs an image signal including an image signal QD(1) for the first area 120 in the pixel unit 110, an image signal QD(2) for the second area 123 and an image signal QD(3) for the dummy pixel 130. The image correcting unit 14 provides the display control unit 24 with the output image signal. The display control unit 24 produces and outputs display data for the pixel unit and display data for the dummy pixel. Further, the display control unit 24 determines a brightness duty ratio (duty ratio of the light emitting control signal GEL), and provides the scan control unit 30 with the determined duty ratio. The duty ratio is ordinarily set to 100 percent.

Further, a display control signal CQ(1) sent from the host and so on through the control signal I/O 22 is provided to the display control unit 24. Further, a display control signal CQ(2) (e.g., copied from CQ(1)) is provided to the image correcting unit 14. The image correcting unit 14 can thereby regularly know a state of an image display, timing for switching to an image of a different kind and so on.

Further, the display control unit 24 produces a brightness correcting signal YC on the basis of the light adjusting signal PXb produced on the basis of the external light intensity and the temperature correcting signal QXb produced on the basis of the temperature. An on/off state of the light emitting control transistor M3 in the pixel PX is controlled by the brightness correcting signal YC. A period of time for which the organic EL element EL emits light is thereby controlled, and the light emitting brightness of the organic EL element EL is thereby adaptively controlled. As, e.g., a screen is rendered hard to see upon the surroundings being light, a brightness correction is made such that the light emitting brightness of the pixel PX increases if the external light is intense (the surroundings are light), and that the light emitting brightness of the pixel PX decreases in comparison with the case where the surroundings are light if the external light is weak (the surroundings are dark). Further, if the brightness of the organic EL element EL increases almost in proportion to an increase of the temperature, a brightness correction is made by means of an opposite correcting characteristic to the brightness change of the organic EL element EL (as to the above example, a characteristic such that the brightness almost linearly falls as the temperature rises) so that the brightness increase can be suppressed. Further, the brightness control unit 24 produces and outputs the display data VDATA (1) for the pixel unit 110 and the display data VDATA(2) for the dummy pixel.

Further, the scan control unit 30 determines the duty ratio of the light emitting control signal GEL (duty ratio of the PWM signal) in accordance with the brightness correcting signal YC and outputs the light emitting control signal GEL of the determined duty ratio. The scan line driver 34 outputs the light emitting control signal GEL after adjusting (transforming upward) the signal level. Further, the scan line driver 34 provides the scan line WL1 with the writing control signal GWRT being synchronized with the light emitting control signal GEL.

As to Light Emitting Brightness Control of Input Image Data Based on of Statistical Data, External Light and Temperature FIG. 2 is a diagram for illustrating a light emitting brightness control based on statistical data of input image data, external light and temperature. As shown in FIG. 2, the image correcting unit 14 has a statistical data acquiring unit (brightness histogram making unit) 1, a brightness histogram analyzing unit 2 and a data correcting unit 3. Further, the display control unit 24 has a lookup table LUT for a temperature correction (reference numeral 4), an input converting unit 5 which converts the light adjusting signal PXb (PWM signal)

coming from the light adjusting unit 13 into a digital signal, an adjusting unit 25 and an output converting unit 7 which converts the digital signal into a PWM signal and outputs the PWM signal.

The statistical data acquiring unit 1 in the image correcting unit 14 shown in FIG. 2 makes and analyzes a brightness histogram of the input image data (DATA). If the brightness of the whole displayed image is, e.g., more than a certain threshold, the statistical data acquiring unit 1 corrects the image data so that the brightness of the whole displayed image decreases. For instance, the brightness histogram analyzing unit 2 analyzes the brightness histogram of the input image data. As a result, e.g., if a brightness average of all the pixels is more than a certain threshold or if the number of pixels for which the light emitting brightness exceeds a certain brightness value (reference brightness) is more than a certain threshold (e.g., more than 80 percent of the whole), the data correcting unit 3 identifies the light emitting brightness of the whole screen as being high and corrects the image data so that the brightness histogram (brightness distribution) shifts to a low brightness side. An amount of the shift to the low brightness side is adaptively controlled in accordance with a result of the brightness histogram analysis. It can be set, e.g., that the amount of the shift to the low brightness side increases as the brightness average of all the pixels exceeds the certain threshold to a greater degree. Even if, e.g., a highly bright image like an all-white image is displayed for a long time, degradation of the pixels is thereby suppressed and screen burn-in less probably occurs. Further, as driving currents of the individual pixels are suppressed, an effect of power consumption reduction in the pixel unit can be obtained. Further, an effect of a longer lifetime of the self-luminescent display panel 100 can be obtained.

Further, the display control unit 24 produces the brightness correcting signal YC as a PWM signal of a variable duty ratio. A period of time for emitting light of the light emitting control transistor M3 (light emitting control element: which plays a role in controlling timing or a period of time for which the self-luminescent element emits light) is controlled by means of the brightness correcting signal YC, so that the light emitting brightness of the individual pixels is controlled. In this case, the image data can be corrected on the basis of the statistical data and the brightness correcting signal is produced on the basis of the external light intensity and the temperature data independently in parallel so that the brightness correction process can be made efficient and easy.

The lookup table LUT for correcting the temperature (reference numeral 4) outputs a temperature correcting coefficient in the display control unit 24. The input converting unit 5 converts the light adjusting signal PXb coming from the light adjusting unit 13 into a digital signal. A digital operation unit 6 performs an operation between the temperature correcting coefficient and the digitized light adjusting signal (e.g., a multiplication process) and adjusts a value of digital data. The adjusting unit 25 adjusts an amount of correction among brightness corrections of different kinds.

That is, if the period of time for emitting light of the light emitting control transistor (light emitting control element) M3 is variably controlled by means of the brightness correcting signal YC that is a PWM signal of a variable duty ratio, and if, e.g., the temperature is high and the surroundings are dark, the duty ratio of the PWM signal can possibly be less than a certain duty ratio value (e.g., 50 percent) in some cases as the light emitting brightness is significantly suppressed. If the duty ratio of the PWM signal is less than, e.g., 50 percent, however, a period of time for which the light emitting element is not lit is made long and can possibly cause a flicker. In such a case, the adjusting unit 25 makes the duty ratio of the PWM signal more than, e.g., 50 percent (i.e., bans a light emitting control such that the duty ratio is lower than the certain duty ratio value, and maintains the duty ratio, e.g., at the certain duty ratio value (i.e., 50 percent)), and instead provides the data correcting unit 3 in the image correcting unit 14 with a brightness adjusting signal TX for compensating an increase of the light emitting brightness of the pixels caused by the change of the duty ratio.

Upon receiving the brightness adjusting signal TX, the image correcting unit 14, e.g., shifts the brightness histogram to the low brightness side and makes a correction for decreasing the brightness value of the whole image so as to make the brightness of the whole image a brightness value indicated by the brightness adjusting signal TX. As, e.g., the duty ratio is less than the certain duty ratio value to a greater degree, an amount of compensation for an increase in the brightness increases, and thus it can be set that the amount of the shift of the brightness of the whole image to the low brightness side increases. The brightness value of the pixels can thereby be optimized and degradation of image quality caused by the flicker can be surely prevented. The output converting unit 7 converts a digital signal output from the adjusting unit 25 into a PWM signal and outputs the PWM signal as the brightness correcting signal YC.

Incidentally, as the method for adjusting the light emitting brightness by means of the brightness correcting signal YC, e.g., a method for further correcting image data corrected on the basis of the statistical data can be employed. If the method for variably correcting the duty ratio of the PWM signal (light emitting control signal GEL) that drives the light emitting control transistor M3 included in the pixel circuit PX is employed, however, there is an advantage in that the correction of the image data (DATA) based on the statistical data and the production of the brightness correcting signal YC based on the external light intensity and the temperature data can be independently performed in parallel, and that the brightness correcting process can be made efficient.

An external light intensity and a temperature can suddenly change in accordance with the environment in some cases for the self-luminescent device (self-luminescent display panel) 200 mounted, e.g., on a portable electronic apparatus 800. According to the embodiment, though, as the correction of the input image data (DATA) and the control of the light emitting brightness based on both the external light and the temperature are performed in piles, the environment in which the self-luminescent device 200 is put and a tendency for brightness of the input image are totally taken into account and an optimum image correction can be implemented. Neither too much nor too little brightness correction is made and quality of displayed image can be enhanced.

Figure 3:
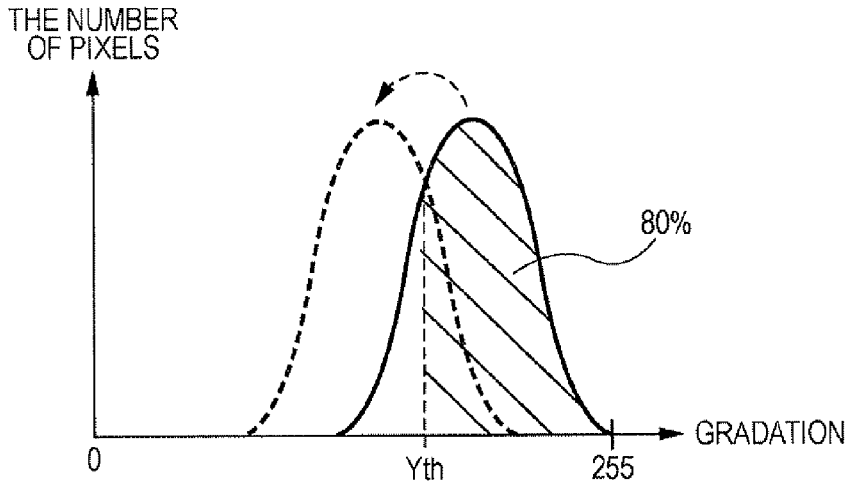
FIG. 3 shows an example of a process performed by a data correcting unit included in an image correcting unit.
Figure 4A:
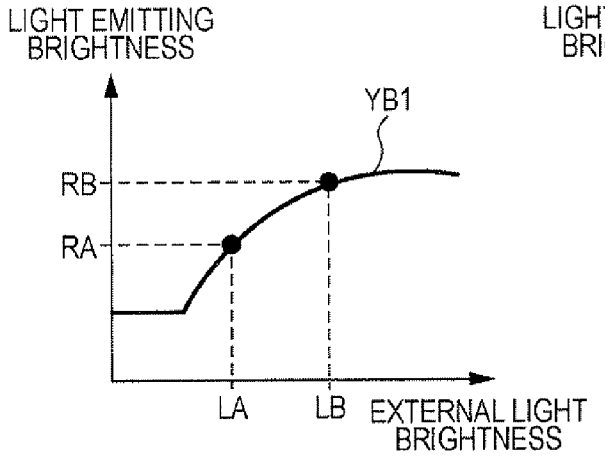
FIGS. 4A and 4B show an example of a correction characteristic for correcting light emitting brightness on the basis of an external light intensity and a temperature.
Figure 4B:
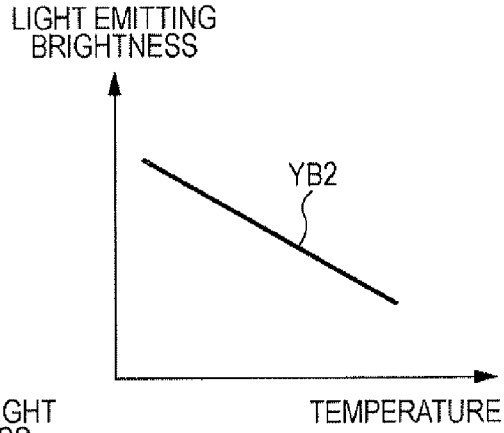

FIG. 3 shows an example of a process performed by the data correcting unit included in the image correcting unit. The image data is corrected here in such a way that, in a case where the number of pixels in the whole pixels for which the light emitting brightness is more than a certain brightness value (reference brightness) is more than a certain threshold (e.g., more than 80 percent of the whole), the data correcting unit identifies the light emitting brightness of the whole screen as being high and shifts the brightness histogram to the low brightness side (an arrow in FIG. 3 indicates the shift). FIGS. 4A and 4B show an example of a correcting characteristic in the correction of the light emitting brightness based on the external light intensity and the temperature. FIG. 4A shows an example of a correcting characteristic (characteristic line YB1) in a case where the light emitting brightness of the self-luminescent element EL is controlled with respect to the external light intensity (external light illuminance). In FIG. 4A, the light emitting brightness of the self-luminescent element EL is adjusted to being RA upon the external light illuminance being LA, and the light emitting brightness of the self-luminescent element EL is adjusted to being RB upon the external light illuminance being LB. FIG. 4B shows an example of a correcting characteristic (characteristic line YB2) in a case where the light emitting brightness of the self-luminescent element EL is controlled with respect to the temperature. In case of FIG. 4B, the light emitting brightness of the self-luminescent element EL is adjusted to almost linearly decreasing as the temperature increases.

Figure 5A:
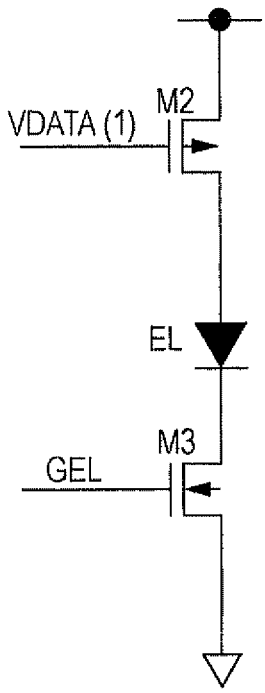
FIGS. 5A and 5B illustrate a process for adjusting light emitting brightness by means of a light emitting control signal.
Figure 5B:
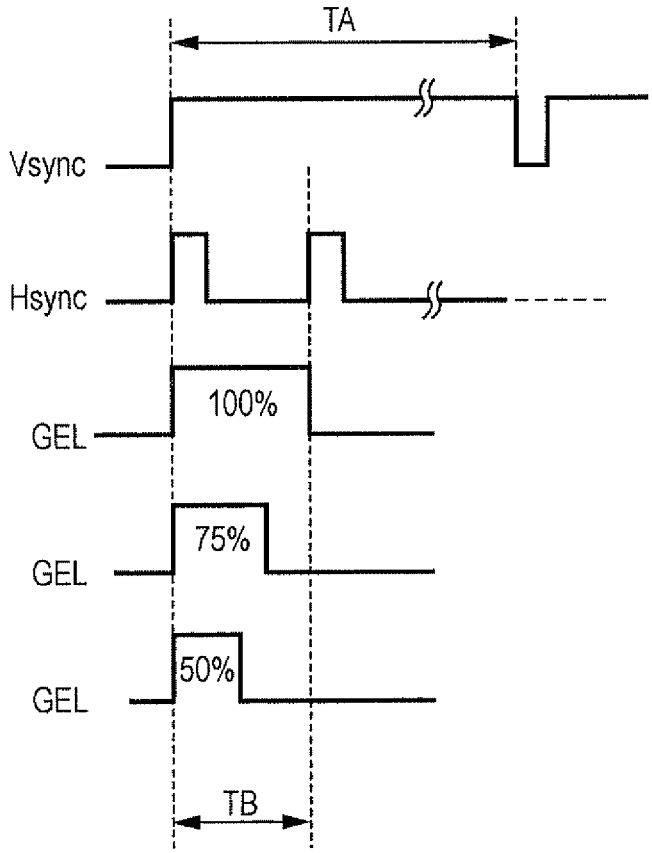

FIGS. 5A and 5B illustrate a process for adjusting the light emitting brightness by means of the light emitting control signal. FIG. 5A shows a configuration of the pixel PX. FIG. 5B shows timing and a duty ratio of the light emitting control signal GEL. In FIG. 5B, symbols Vsync and Hsync represent a vertical synchronization signal and a horizontal synchronization signal, respectively. Symbols TA and TB represent a period of time for vertical synchronization and a period of time for which one pixel is ready to emit light (longest period of time for emitting light), respectively. If the duty ratio of the light emitting control signal GEL is 100 percent, the light emitting control transistor M2 is kept on during the whole period of time TB. If the duty ratio of the light emitting control signal GEL is 75 percent, the period of time for emitting light is made three quarters. If the duty ratio of the light emitting control signal GEL is 50 percent, the period of time for emitting light is made half. If, e.g., the period of time for emitting light is made half, time-averaged light emitting brightness is made half as an amount of emitted light per a unit of time is made half.

Figure 6:
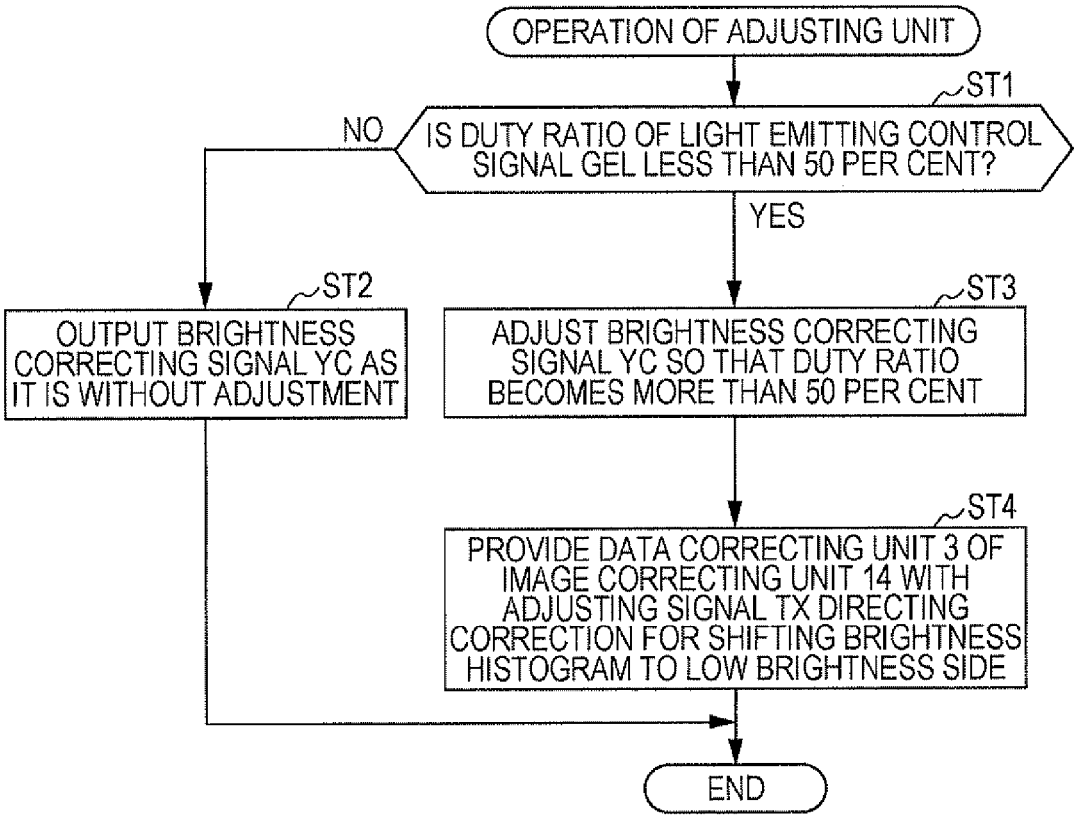
FIG. 6 shows an example of a procedure of an adjustment process performed by an adjusting unit.

FIG. 6 shows an example of a procedure for the adjusting process performed by the adjusting unit 25. The adjusting unit 25 included in the display control unit 24 identifies whether the duty ratio of the light emitting control signal GEL is less than 50 percent (step ST1). If the duty ratio is more than 50 percent, the adjusting unit 25 outputs the brightness correcting signal YC as it is without adjustment (step ST2). If the duty ratio is less than 50 percent, the adjusting unit 25 adjusts the brightness correcting signal YC in such a way that the duty ratio of the light emitting control signal GEL becomes more than 50 percent (step ST3). Then, the adjusting unit 25 provides the data correcting unit 3 in the image correcting unit 14 with the brightness adjusting signal TX for compensating an increase in the light emitting brightness of the pixels (including an instruction for shifting the brightness histogram to the low brightness side) (step ST4).

Second Embodiment

According to the embodiment, the self-luminescent device controls a compensation for secular degradation on the basis of the detection signal IX of the brightness sensor unit 135 in addition to the three kinds of light emitting brightness correction (image correction based on statistical data of input image data, brightness correction based on external light and temperature) described above. That is, focus on a portion in which secular degradation is expected to be severe and intensively correct brightness in an area close to an interface between that portion and the surroundings, so that size of pixels to be corrected can be made small and the load of the correcting circuit can be reduced. Brightness unevenness can be efficiently and effectively prevented from occurring, e.g., in an area in which a same image is displayed for a long time and in the surrounding area by means of the compensation for secular degradation. According to the embodiment, four kinds of light emitting brightness control are performed.

Figure 7:
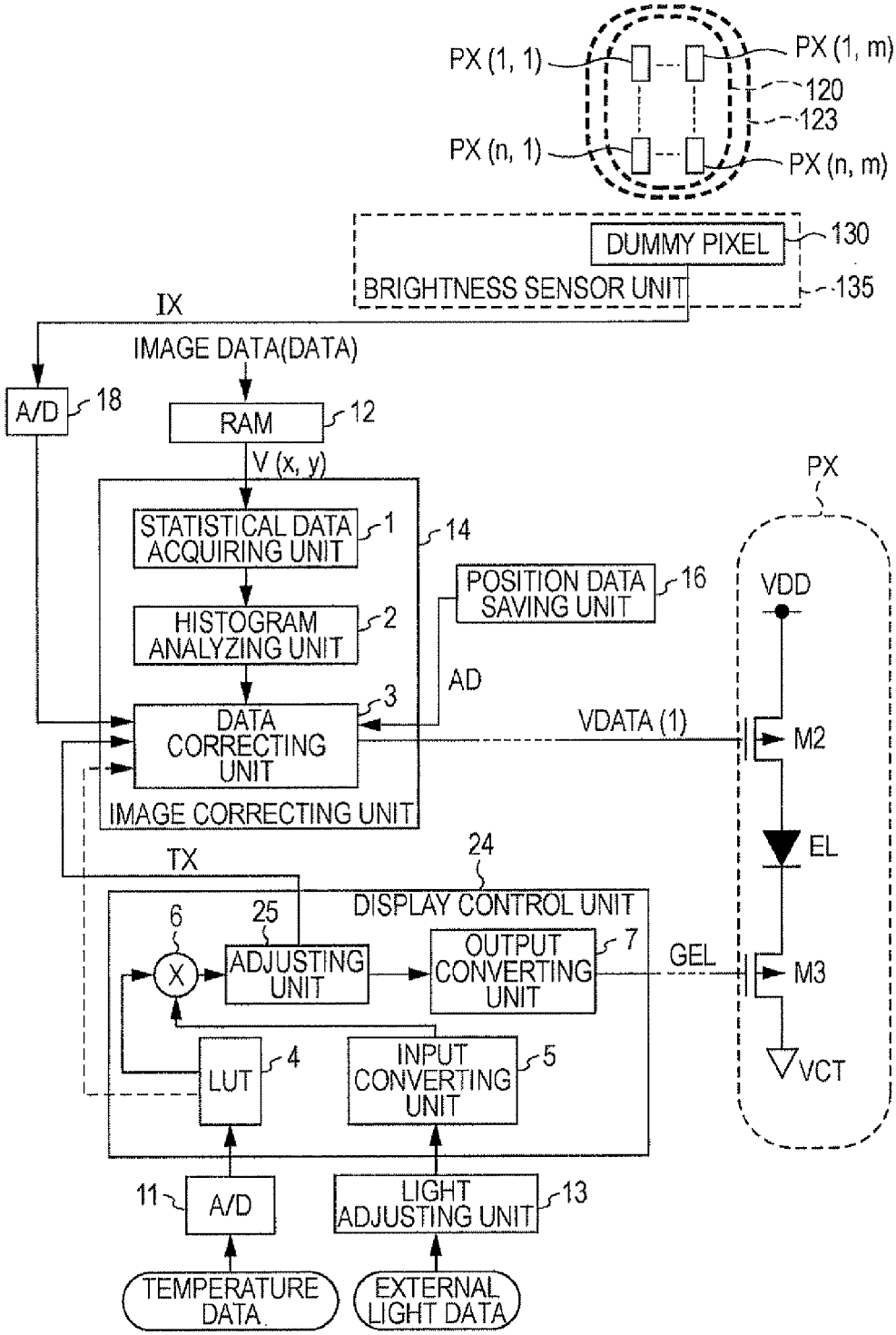
FIG. 7 shows a configuration of another example (which also performs a compensation control for degradation) of the self-luminescent display device of the invention.

FIG. 7 shows a configuration of another example of the self-luminescent display device (an example of also performing compensation control for degradation). In FIG. 7, the A/D converting circuit 18 converts the signal IX output from the brightness sensor unit 135 into a digital signal, and the image correcting unit 14 is provided with the digital signal.

Figure 8:
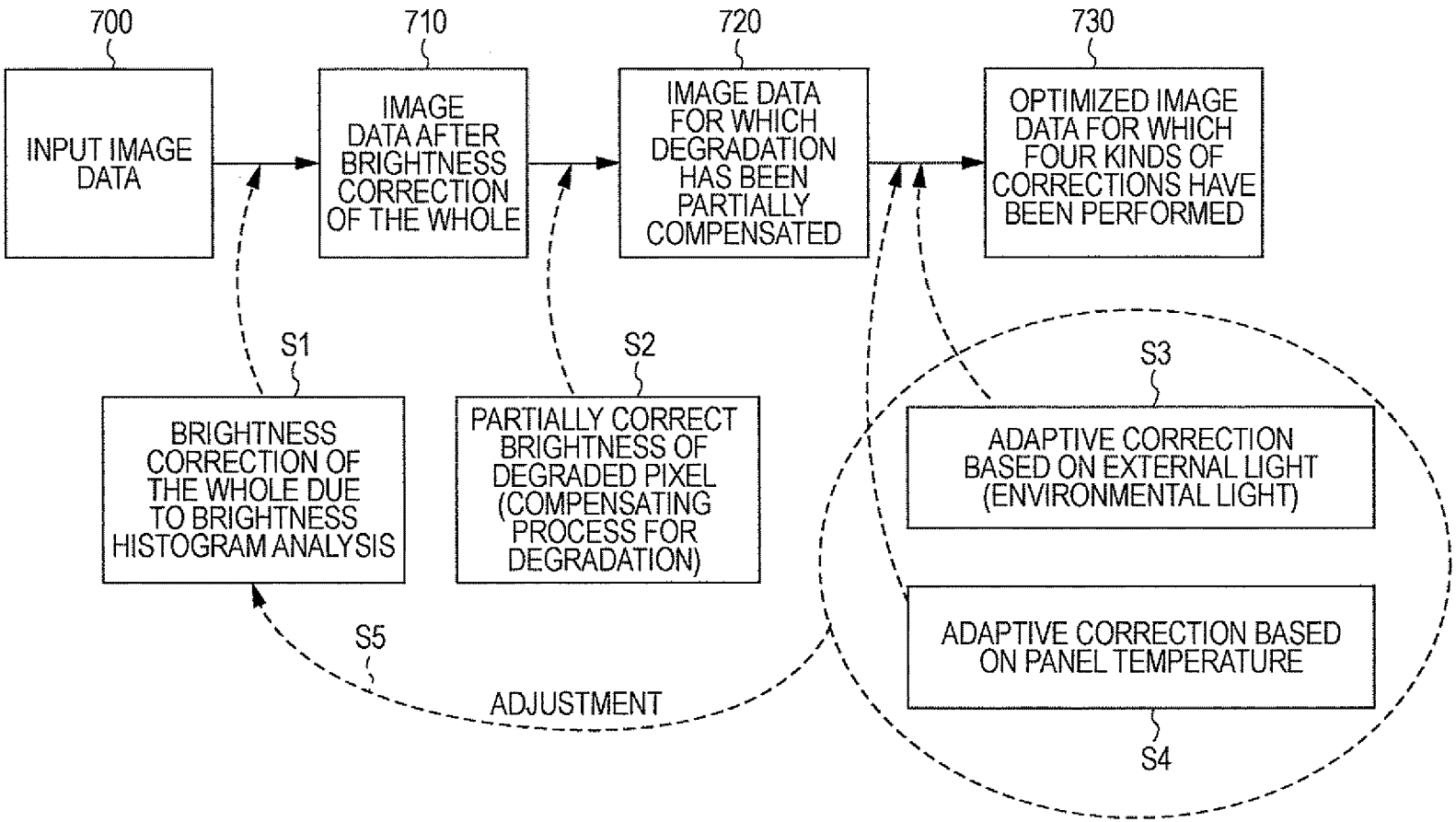
FIG. 8 shows an example of a procedure of a process for performing four kinds of brightness correction control including a compensation process for degradation.

FIG. 8 shows an example of a procedure for performing the four kinds of brightness correcting control including the compensation process for degradation. Brightness of the whole image is corrected by means of the brightness histogram analysis at a step S1. Brightness of degraded pixels is partially corrected by means of the compensation process for degradation at a step S2. The light emitting brightness is adaptively corrected on the basis of external light (environmental light) at a step S3. The light emitting brightness is adaptively corrected on the basis of the panel temperature at a step S4. Further, if the duty ratio of the light emitting control signal is less than a certain duty ratio value possibly causing a flicker as a result of the steps S3 and S4, the adjusting unit 25 makes the adjustment as described above (step S5).

As the three kinds of the correction was explained as to the previous embodiment, configurations or operations related only to the compensating process for secular degradation will be explained hereafter.

(As to Compensation Control for Secular Degradation)

Figure 9A:
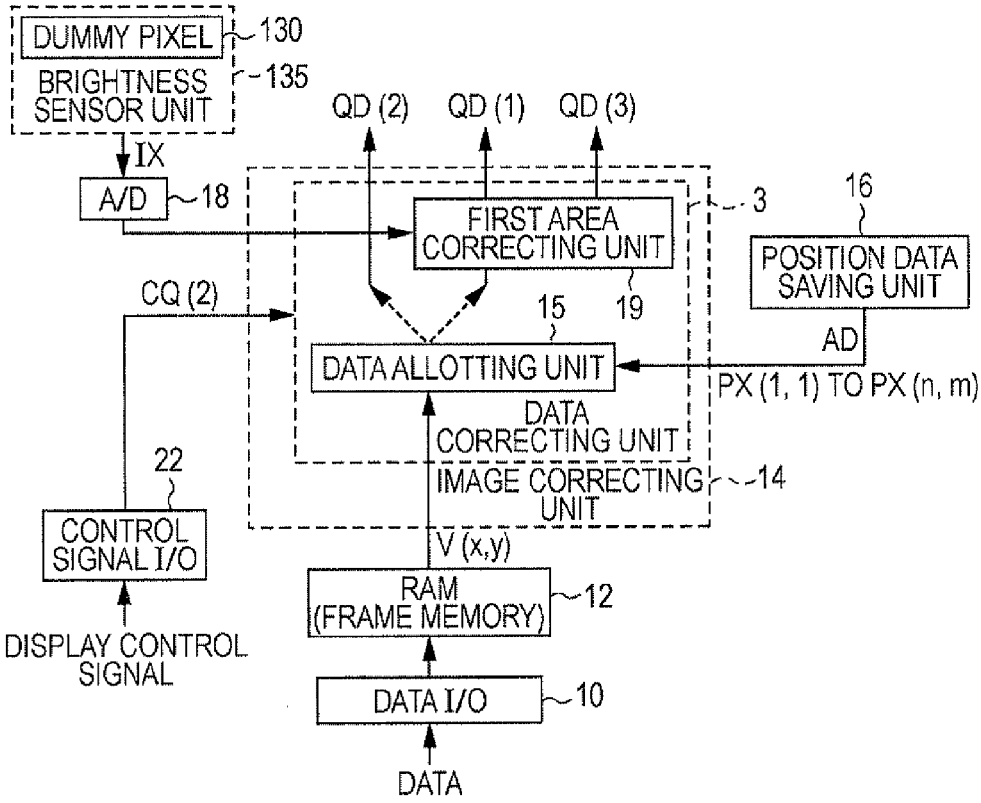
FIGS. 9A and 9B illustrate examples of configurations and operations for performing the compensation process for degradation by means of the image correcting unit.

FIGS. 9 and 10 illustrate examples of a configuration and an operation of a portion which performs the compensation process for degradation in the image correcting unit. In FIG. 9A, the image correcting unit 14 (to put it more specifically, the data correcting unit 3 shown in FIG. 2) corrects the light emitting brightness in the first are 120 (i.e., makes a correction for decreasing the brightness value having increased as light emitting time passes) on the basis of the detection signal IX of the brightness sensor unit 135, so as to reduce a difference compared with the light emitting brightness in the surrounding area 123 and to prevent brightness unevenness.

The image correcting unit 14 in FIG. 9A has a data allotting unit 15 and a first area correcting unit 19. Further, in FIG. 9A, a frame memory is used as the RAM 12 (a line memory can also be used). For the compensation process for secular degradation, the data allotting unit 15 compares position data AD (including the position data of the first area 120 (PX(1,1)-PX(n,m))) saved in the position data saving unit 16 constituted by a ROM and so on with the position data of the image data (DATA) (address data of the frame memory 12) so as to distinguish the first area 120 from the second area 123, and allots the image data (display data: DATA) for the first area 120 to the first area correcting unit 19. Meanwhile, the image data (DATA) for the second area 123 is output as it is as the image signal QD(2) for the second area.

The first area correcting unit 19 produces a correcting data ΔCD for decreasing the brightness of pixels having increased owing to long time light emission on the basis, e.g., of the detection signal IX output from the brightness sensor unit 135, and adds the correcting data ΔCD (negative data) to the image data (DATA) for the first area 120 by using an adder. The image data is thereby corrected for decreasing the brightness. A method for correction is not limited to the above described as just an example. A method for correction can be employed such that, e.g., the first area correcting unit 19 produces a correcting coefficient KC on the basis of the detection signal IX output from the brightness sensor unit 135 and multiplies the image data (DATA) for the first area 120 by the correcting coefficient KC. Further, image data after correction can be obtained by means of a correction operation according to a certain equation that uses computed correcting data. The first area correcting unit 19 produces and outputs the image signal QD(1) for the first area 120 and the image data QD(3) for the dummy pixel 130. The image signal QD(3) for the dummy pixel 130 can be a same image signal as the image signal QD(1) for the typical pixel (watched pixel) in the first area 120.

Figure 9B:
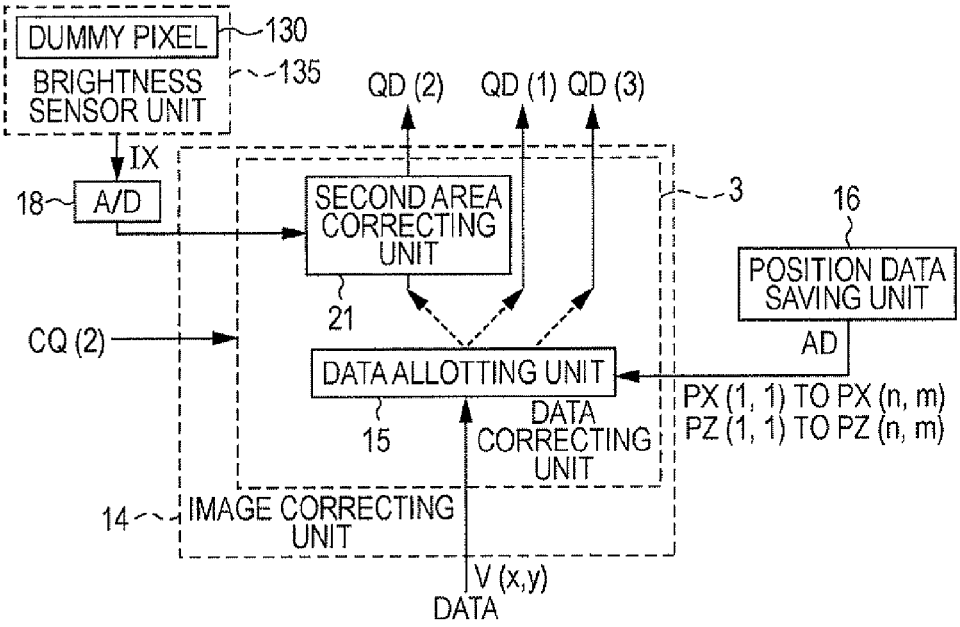

In FIG. 9B, the image correcting unit 14 has the data allotting unit 15 and a second area correcting unit 21. Incidentally, the second area 123 is included in an area not being monitored. For the compensation process for secular degradation, the data allotting unit 15 compares the position data AD (further including position data of the second area 123 (PZ(1,1)-PZ(n,m)) in addition to the position data of the first area 120 (PX(1,1)-PX(n,m))) saved in the position data saving unit 16 with the position data of the image data (DATA) (address data of the frame memory 12) so as to distinguish the second area 123 from the first area 120, and allots the image data (display data: DATA) for the second area 123 to the second area correcting unit 21. The image data (DATA) for the first area 120 and the image data (DATA) for the dummy pixel 130 are output as they are as the image signal QD(1) for a compensating area for degradation and the image signal QD(2) for the dummy pixel, respectively.

The second area correcting unit 21 corrects the image data (DATA) for the second area 123 on the basis, e.g., of the detection signal IX output from the brightness sensor unit 135, so as to increase the light emitting brightness of the pixels and to reduce a difference compared with the light emitting brightness in the first area 120 having increased owing to long time light emission. Produce correcting data ΔCD for increasing the light emitting brightness on the basis, e.g., of the detection signal IX output from the brightness sensor unit 135, and add the correcting data ΔCD (positive data) to the image data (DATA) for the second area 123 by using an adder, so that the correction of the image data (DATA) for the second area 123 can be implemented. As a result, the second area correcting unit 21 outputs the corrected image signal QD(2) for the second area. As described above, the image data for the second area 123 can also be corrected by means of an operation that uses the correcting coefficient or an operation that uses a certain equation.

While the first area 120 and the second area 123 include a plurality of pixels, all the pixels can be targets for correction of light emitting brightness and only particular one(s) of the pixels (one or more pixel(s)) can be a target (targets) for correction of light emitting brightness. If the above aspects are considered, it can be said that the image correcting unit 14 corrects light emitting brightness of at least one of at least one of the pixels included in the first area 120 and at least one of the pixels included in the second area 123 on the basis of the detection signal IX of the brightness sensor unit 135 (detected output signal of the dummy pixel 130) so that the difference between the light emitting brightness of at least one of the pixels included in the first area (degradation monitoring area) 120 and the light emitting brightness of at least one of the pixels included in the second area (surrounding area) 123.

Further, the image correcting unit 14 can make all the pixels included in the first area (all of PX(1,1)-PX(n,m) shown in FIG. 1) and all the pixels included in the second area 123 targets for the compensating process for secular degradation. In this case, e.g., the image correcting unit 14 can correct at least one of the light emitting brightness of all the pixels included in the first area 120 and the light emitting brightness of all the pixels included in the second area 123 so that a difference between an average value of the light emitting brightness of all the pixels included in the first area 120 and an average value of the light emitting brightness of all the pixels included in the second area 123 decreases. As a difference between the brightness level of the whole first area 120 and the brightness level of the whole second area 123 thereby decreases, brightness unevenness is suppressed and degradation of image quality is thereby prevented in spite of a change of the light emitting characteristics of the pixels included in the first area 120 accompanied by secular degradation of the pixel circuit and so on.

Further, as described above, the image correcting unit 14 can make particular one(s) (one or more pixel(s)) of all the pixels included in the first area 120 and in the second area 123 a target (targets) for the compensating process for secular degradation. In this case, the image correcting unit 14 can correct at least one of the light emitting brightness of the particular pixel(s) included in the first area 120 and the light emitting brightness of the particular pixel(s) included in the second area 123 so that a difference between the light emitting brightness of the one or more particular pixel(s) included in the first area 120 and the light emitting brightness of the one or more particular pixel(s) included in the second area 123 decreases. In this case, e.g., the number of the particular pixels can be limited, so that a load of the image correcting unit 14 can be reduced. It is preferable to carefully select a pixel (pixels) at which position as the particular pixel(s), and to obtain a maximum effect of suppressing brightness unevenness by means, e.g., of light emitting brightness correction of the minimum number of the pixels.

First Example of Applying Compensation Process for Degradation

In a case where the image displayed in the pixel unit 110 changes from a first image to a second image, a compensation process for secular degradation is performed in a period of time for displaying the second image as the compensation process for degradation.

Figure 10A:
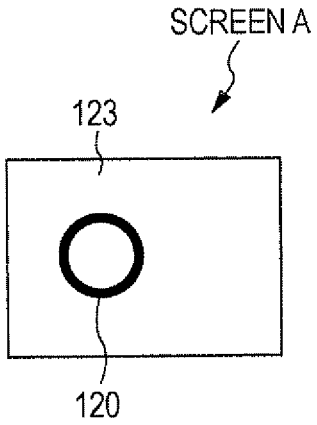
FIGS. 10A-10D show an example of performing a compensation for secular degradation after changing an image.

FIGS. 10A-10D show an example of performing the compensation process for secular degradation after the image changes. Assume here that an organic BL display panel installed on a vehicle displays meters while the vehicle is traveling and displays a navigation or TV screen while the vehicle is not traveling. In FIG. 10A, a screen A is a screen displayed while the vehicle is traveling. The first area 120 is an area for displaying, e.g., outer fringes, gauges or numerals of the meters. As the pixels in the first area 120 regularly emit light and its display data is rarely changed, screen burn-in can possibly occur.

Figure 10B:
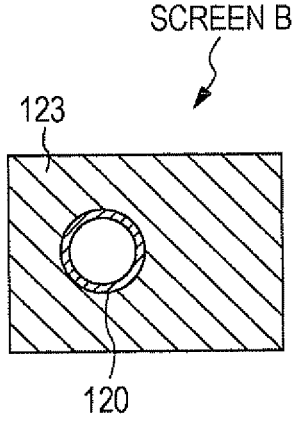

In a case where the displayed image is changed from the image of the meters (image A) to the image of navigation or TV screen (image B) after screen burn-in occurs in the first area (degradation monitoring area) 120 as shown in FIG. 10B, brightness in the portion where the screen burn-in has been caused by the display of the meters may possibly change from a precise value beyond an allowable range and the difference compared with the light emitting brightness in the second area (surrounding area, circumferential area) 123 increases, causing brightness unevenness. In this case, image quality of the navigation or TV screen (image B) that should primarily be highly precise is rendered poor.

Figure 10C:
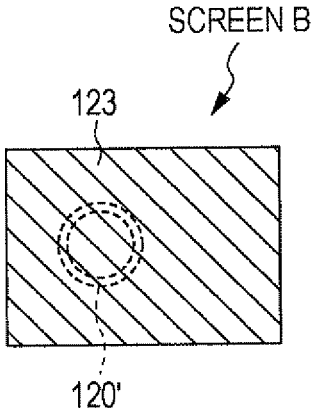
Figure 10D:
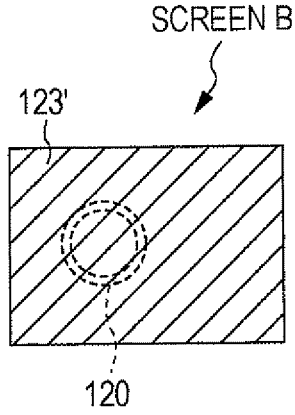

Then, perform the compensation process for secular degradation explained as to the above embodiment. In FIG. 10C, a correction for decreasing the brightness in the first area 120 is made. In FIG. 10C, a reference numeral 120' indicates the first area (degradation monitoring area) in which the brightness has been corrected. In FIG. 10D, a correction for increasing the brightness in the second area (surrounding area or circumferential area) 123 is made. In FIG. 10D, a reference numeral 123' indicates the second area (degradation monitoring area) in which the brightness has been corrected. As image data (display data) is corrected as shown in FIGS. 10C and 10D, a change of display brightness caused by screen burn-in can be suppressed and a degree of image quality degradation can be kept at a minimum. Incidentally, the correction for decreasing the brightness in the first area 120 and the correction for increasing the brightness in the second area 123 can be made in parallel.

Incidentally, e.g., while the meters are displayed, a portion of the gauge may intermittently blink and color of the numeral may secularly change in some cases. Such a change of the image is a change in the same image and is not a changeover to a different image. In case of a changeover to a different image, the image after the changeover has no relation to the image before the changeover. Thus, if a significant change of the brightness characteristic that occurred in some area before the changeover of the image affects the image after the changeover, an unnatural change of the image quality occurs in the image after the changeover. Thus, according to the embodiment, in case of a changeover to a different image (i.e., in case of a changeover from a first image to a second image), the compensation process for secular degradation is performed for the image after the changeover so that such a problem is prevented.

Incidentally, the compensation process for degradation can be regularly performed in the state shown in FIG. 10A (the state in which the screen A is displayed). Further, the compensation process for degradation can be performed after the changeover to the screen B (the state shown in FIG. 10C or 10D) while not being performed in the state shown in FIG. 10A. As the compensation process for degradation is not performed at the phase shown in FIG. 10A in the latter case, a load of the image correcting unit 14 can be reduced. Further, in case of the changeover from the state shown in FIG. 10A to the state shown in FIG. 10C or 10D, a certain period of time for the changeover is usually set. If correction data for image correction is prepared during the period of time, the image can be corrected in real time immediately after the changeover to the image B.

Second Example of Applying Compensation Process for Degradation

Figure 11A:
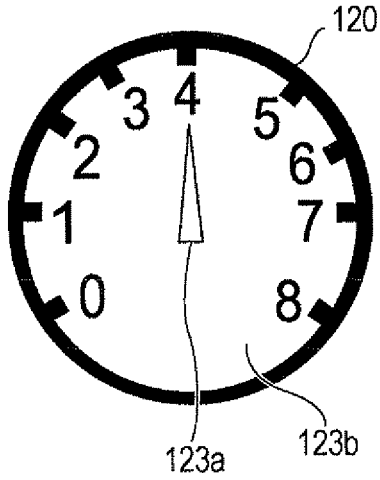
FIGS. 11A-11C show an example of performing a compensation for secular degradation while an image is continuously displayed.
Figure 11B:
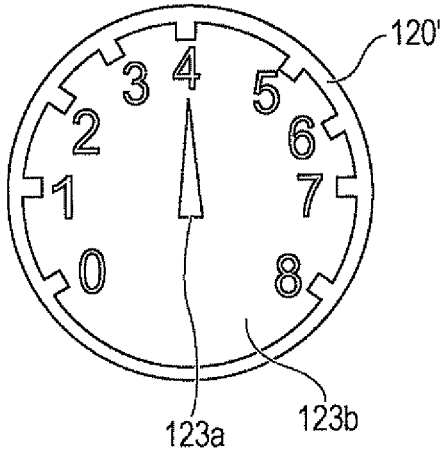
Figure 11C:
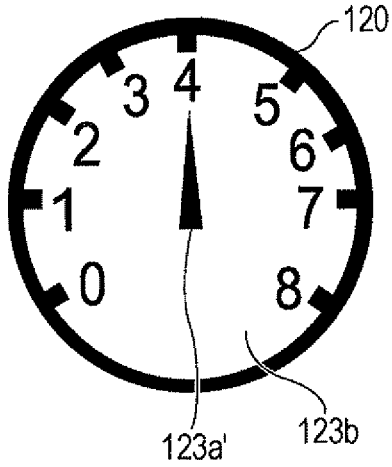

The compensation process for degradation can be performed while, e.g., the self-luminescent device 200 continuously displays an image. FIGS. 11A-11C illustrate an example of performing the compensation process for secular degradation while continuously displaying an image.

In FIGS. 11A-11C, meters are displayed on the self-luminescent panel. While the display of the meters is indispensable, e.g., for safe operation of vehicles or aircraft or observance of driving rules, the meters are quite probably regularly displayed by emitted light for a long time and a portion which regularly emits light supposedly suffers from serious degradation of the pixel characteristic in some cases. Thus, it is effective to perform the compensation for degradation of the invention.

In FIG. 11A, the first area 120 is an area in which outer fringes, gauges or numerals of the meters are displayed (shown as painted with black in FIG. 11A for convenience of explanation). An area of a needle portion 123*a* and a background area 123*b* both can be set as the second area 123. As it is considered, though, that the background portion is visually inconspicuous, assume here that only the needle portion area 123*a* is set as the second area 123 in advance.

In FIG. 11B, the image correcting unit 14 makes a correction for decreasing the brightness in the first area 120. In FIG. 11B, the reference numeral 120' indicates the first area in which the brightness has been corrected. Further, in FIG. 11C, a correction for decreasing the brightness in the second area (surrounding area) 123 is made. In FIG. 11C, a reference numeral 123*a'* indicates the second area (surrounding area) in which the brightness has been corrected. As image data is corrected as shown in FIGS. 11B and 11C, the difference between the brightness in the first area 120 (the outer fringe, gauge or numeral portions which regularly emit light) and the brightness in the second area 123 surrounding the first area (e.g., needle portions of meters indicated only in case of necessity) is reduced, so that brightness unevenness can be prevented and a visually natural image can be regularly obtained. In FIG. 11C, the image can also be corrected in the background portion 123*b*. If the background portion 123*b* has an insignificant effect on the human sense of sight, however, only the image in the needle portion 123*b* can be corrected without causing a particular problem. As the target pixels for the image correction decrease in this case, there is an effect in that the processing load of the image correcting unit 14 can be reduced. Incidentally, the correction for decreasing the brightness in the first area 120 and the correction for increasing the brightness in the second area 123 (more specifically 123*a*, and 123*b* can be included as necessary) can be made in parallel.

Further, the compensation process for secular degradation can be regularly performed throughout a period of time for which the display panel is in operation. Further, the compensation for secular degradation can be performed only if the degradation goes beyond an allowable level in the first area 120 (e.g., if a quantity of a current consumed by the dummy pixel which shows the brightness level of the dummy pixel 130 goes beyond a threshold) instead of regularly performing the process for secular degradation. As the period of time for the compensation for secular degradation is shortened in this case, the load of the image correcting unit and power consumption of the circuit can be reduced.

As described above, according to at least one embodiment of the invention, the light emitting brightness of the self-luminescent display device can be optimized and, preferably, the compensation for degradation can be performed for the screen burn-in which partially occurs by means of, e.g., the adaptive control which deals with all the heat generation caused by environmental temperature, external light and self-luminescent light. Thus, the self-luminescent display device which can regularly perform the optimum light-emitting brightness control, regularly enable a display of high quality and prevent power consumption from increasing. The electronic apparatus equipped with the self-luminescent display device of the invention similarly enjoys a benefit of regularly enabling a display of high image quality, small size and low power consumption.

Incidentally, the embodiment was described in detail. It is conceivable that a person with an ordinary skill in the art can easily understand that the invention can be variously modified within the scope of the novelty and effect of the invention. Thus, all such modifications are supposed to be included in the invention. For instance, the image correction based on statistical data of input image data can incorporate a more complicated correction process, and the brightness correction based on an external light intensity and temperature data can use a more complicated correcting characteristic. Further, the load of the circuit, power consumption and the characteristic of the display panel should be considered, so that timing and the number of repetition of the compensation for secular degradation can be properly determined. A kind and a characteristic of a displayed image and so on should be considered, so that a target area for the degradation monitoring and its size can be properly determined. Further, e.g., an LED (light emitting diode) can be used and another self-luminescent element can be employed as the self-luminescent element instead of the organic EL element that is a self-luminescent element of a current-driven type.

The entire disclosure of Japanese Patent Application No. 2009-101030, filed Apr. 17, 2009 is expressly incorporated by reference herein.

What is claimed is:

1. A self-luminescent display device comprising:

a pixel unit in which a plurality of pixels including a self-luminescent pixel is arranged;

an external light sensor which measures an external light intensity;

a temperature sensor which measures an external environmental temperature;

an image correcting unit which corrects image data input to the image correcting unit on the basis of statistical data of the image data;

a light adjusting unit which produces a light adjusting signal on the basis of a measurement signal produced from the external light intensity by the external light sensor;

a temperature control unit which produces a temperature correcting signal on the basis of a measurement signal produced from the external environmental temperature by the temperature sensor;

an adjusting unit which changes, upon a duty ratio of a brightness correcting signal being as a pulse width modulation (PWM) signal is less than a certain duty ratio, the duty ratio of the brightness correcting signal being as the PWM signal to a value more than the certain duty ratio, the adjusting unit providing the image correcting unit with a brightness adjusting signal for compensating for an increase of the light emitting brightness of the pixels caused by the change of the duty ratio; and a display control unit which produces a brightness correcting signal for controlling light emitting brightness of the pixels in the pixel unit on the basis of the light adjusting signal and the temperature correcting signal, wherein the light emitting brightness of the pixels in the pixel unit is adjusted on the basis of the image data corrected by the image correcting unit and the brightness correcting, signal, each of the pixels has a self-luminescent element, a driving transistor which provides the self-luminescent element with a driving current, and a light emitting control transistor which controls a period of time for which the self-luminescent element emits light, the image correcting unit makes a brightness histogram of the input image data, the image correcting unit analyzing the brightness histogram, the image correcting unit correcting the image data provided to the pixels upon a brightness value of a whole image being more than a certain threshold so that brightness of the whole image decreases, and the display control unit produces the brightness correcting signal as the PWM signal of a variable duty ratio on the basis of the external light intensity and the environmental temperature, the display control unit controlling an on/off state of the light emitting control transistor in the pixel by means of the brightness correcting signal as the PWM signal of the variable duty ratio.

2. The self-luminescent display device according to claim 1, wherein:

the self-luminescent element is an organic EL element.

3. An electronic apparatus comprising the self-luminescent display device according to claim 1.

* * * * *